US009596938B2

(12) United States Patent
Le et al.

(10) Patent No.: US 9,596,938 B2
(45) Date of Patent: Mar. 21, 2017

(54) FOLDING CHAIR

(71) Applicant: HEB Grocery Company LP, San Antonio, TX (US)

(72) Inventors: Tuan Thanh Le, Live Oak, TX (US); Carlos S. Rivera, Selma, TX (US); Hal B. Ramsey, III, San Antonio, TX (US)

(73) Assignee: HEB Grocery Company, LP, San Antonio, TX (US)

( * ) Notice: Subject to any disclaimer, the term of this patent is extended or adjusted under 35 U.S.C. 154(b) by 0 days.

(21) Appl. No.: 14/681,941

(22) Filed: Apr. 8, 2015

(65) Prior Publication Data

US 2016/0296022 A1 Oct. 13, 2016

(51) Int. Cl.

| | |
|---|---|
| ***A47C 4/28*** | (2006.01) |
| ***A47C 7/52*** | (2006.01) |
| ***A47C 7/54*** | (2006.01) |

(52) U.S. Cl.

CPC ..... *A47C 4/286* (2013.01); *A47C 7/52* (2013.01); *A47C 7/54* (2013.01)

(58) Field of Classification Search

CPC .. A47C 4/28; A47C 4/286; A47C 4/38; A47C 4/48; A47C 4/52; A47C 7/52; A47C 7/54

USPC ..... 297/16.2, 45, 30, 16.1, 423.19, 423.25, 297/423.26, 423.4

See application file for complete search history.

(56) References Cited

U.S. PATENT DOCUMENTS

| | | | | |
|---|---|---|---|---|
| 1,895,115 | A * | 1/1933 | Williams | A47C 4/283 297/36 |
| 2,800,951 | A * | 7/1957 | Szabo | A47C 4/46 297/29 |
| 3,414,321 | A * | 12/1968 | Beck | A47C 4/40 297/29 |
| 6,296,304 | B1 * | 10/2001 | Zheng | A47C 4/286 297/21 |
| 8,465,090 | B1 * | 6/2013 | O'Connor | A47C 7/62 297/184.16 |
| 8,690,236 | B2 * | 4/2014 | Gorinas | A47C 4/286 297/118 |
| 2014/0167455 | A1 * | 6/2014 | Holland | A47C 4/286 297/16.2 |
| 2014/0339859 | A1 * | 11/2014 | Holland | A47C 3/34 297/19 |
| 2014/0346818 | A1 * | 11/2014 | Yang | A47C 4/286 297/16.2 |

FOREIGN PATENT DOCUMENTS

| | | | | |
|---|---|---|---|---|
| WO | WO 0217750 | A1 * | 3/2002 | A47C 3/029 |

* cited by examiner

*Primary Examiner* — Ryan Kwiecinski
(74) *Attorney, Agent, or Firm* — Baker Botts L.L.P.

(57) ABSTRACT

A folding chair apparatus is provided. In one embodiment, the folding chair apparatus comprises a plurality of vertical posts, a plurality of cross-braces, and a plurality of legs that each comprise an upper portion and a lower portion wherein the legs, cross-braces, and vertical posts are coupled together to form a frame, wherein the vertical posts define one or more planes, and wherein the lower portions of the at least two legs extend outwardly from the upper portions of the at least two legs beyond at least one of the planes; and a seat coupled to the frame.

19 Claims, 6 Drawing Sheets

FOLDING CHAIR

BACKGROUND

The present disclosure relates to a folding chair. Folding chairs are generally lightweight and designed for portability and ease of use. However, the collapsible and lightweight construction sometimes makes such chairs unstable and difficult to use. Tall folding chairs also may be particularly unstable because of the high center of gravity, potentially making them uncomfortable and difficult to use.

BRIEF DESCRIPTION OF THE DRAWINGS

These drawings illustrate certain aspects of some of the embodiments of the present disclosure, and should not be used to limit or define the claims.

Figure 1:
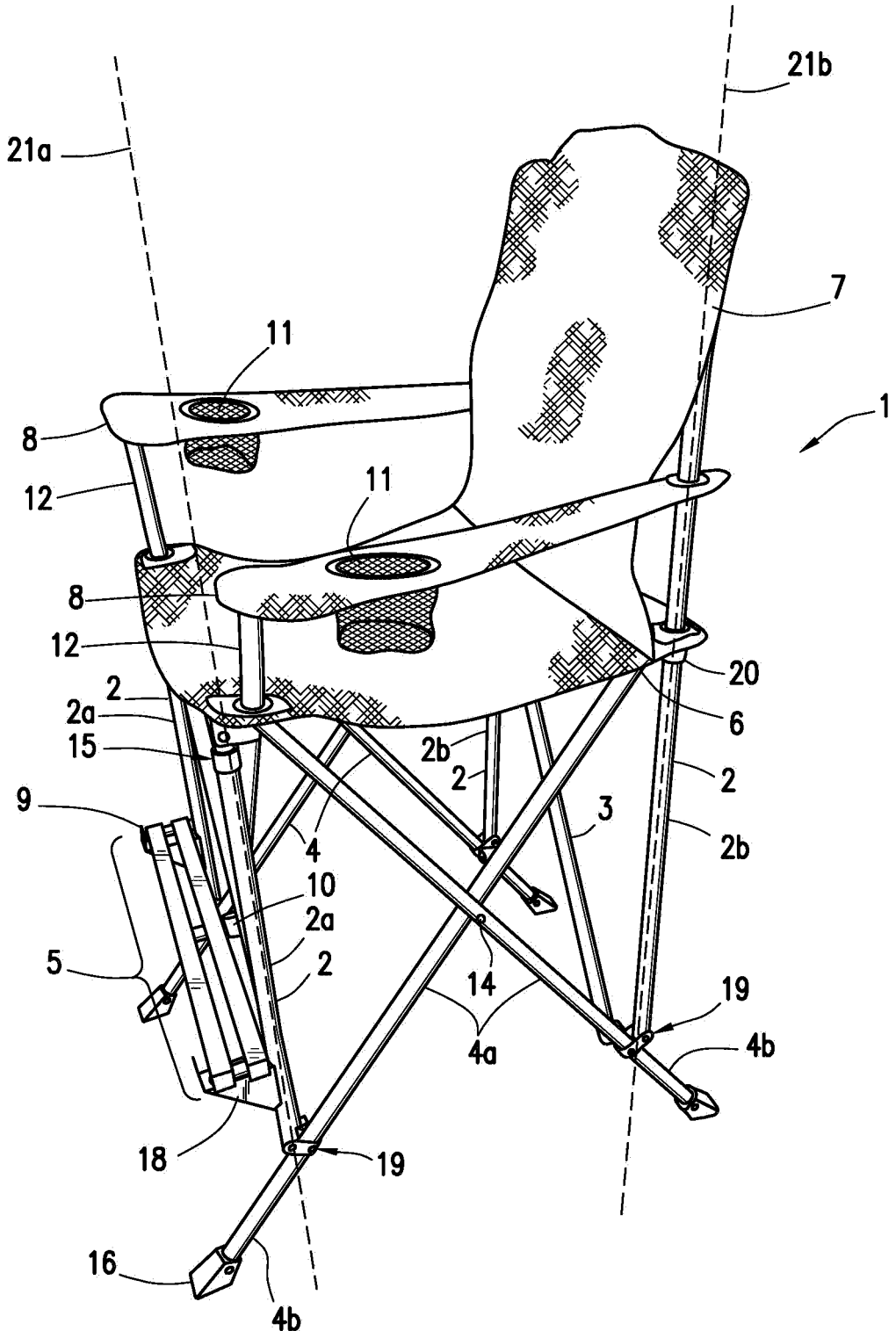
FIG. 1 is a perspective view of a chair configuration according to certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The present disclosure relates to a folding chair apparatus, and more particularly to a folding chair apparatus with outwardly extending legs. More specifically, the present disclosure provides a folding chair apparatus comprising a plurality of vertical posts, a plurality of cross-braces, and a plurality of legs that each comprise an upper portion and a lower portion wherein the legs, cross-braces, and vertical posts are coupled together to form a frame, wherein the vertical posts define one or more planes, and wherein the lower portions of at least two legs extend outwardly from the upper portions of the at least two legs beyond at least one of the planes; and a seat coupled to the frame. In certain embodiments, a pair of back vertical posts define a back plane and the lower portion of at least two legs extends outwardly from the upper portion of the at least two legs beyond the back plane. In certain embodiments, a pair of front vertical posts define a front plane and a pair of back vertical posts define a back plane, the lower portion of at least two legs extends outwardly from the upper portion of the at least two legs beyond the front plane, and the lower portion of at least two legs extends outwardly from the upper portion of the at least two legs beyond the back plane.

In certain embodiments, the folding chair apparatus comprises a step pivotally coupled to at least one of the cross-braces, vertical posts, or legs, wherein the step is positioned at a front of the chair below the seat. In some embodiments, the step may be manually manipulated from a vertical to a horizontal orientation when the folding chair is unfolded. In some embodiments, the step does not automatically move from a vertical to a horizontal orientation when the folding chair is unfolded.

Among the many potential advantages to the apparatus of the present disclosure, only some of which are alluded to herein, the apparatus of the present disclosure may provide a folding chair providing increased stability, comfort, and/or usability. For example, the outwardly extending legs may provide a wider frame at the base of the chair, providing more support and stability. In certain embodiments, the more stable frame may allow for a stable folding chair of an increased height (e.g., "barstool" or "counter" height) as compared to many conventional folding chairs. Another advantage of the present disclosure is the step. In certain embodiments, the step may provide further stability to the frame by connecting frame elements, function as a foothold to facilitate entry and exit from the chair, and/or may serve as a footrest while the user is seated in the chair.

Embodiments of the present disclosure and their advantages are best understood by references to FIGS. 1 through 7, where like numbers are used to indicate like and corresponding features.

FIG. 1 depicts a folding chair 1 with a frame comprising vertical posts 2, cross-braces 3, and legs 4. In some embodiments, the folding chair may be a collapsible chair, bag chair, camp chair, quad chair, arm chair, or any combination thereof. In the embodiments depicted in the figure, the vertical posts 2, cross-braces 3, and legs 4 are coupled together to form a frame to support the seat 6, back 7, and armrests 8. The legs 4 are coupled together at pivot points 14, and may comprise an upper portion **4*a* and a lower portion 4*b*. The upper portion 4*a* and the lower portion 4*b* may be part of a continuous leg 4, or they may be coupled together (not depicted). In some embodiments, the upper portion 4*a* and the lower portion 4*b* are divided by the coupling point 19 of the vertical post 2 and the leg 4. For example, in certain embodiments the portion of the leg 4 above the coupling point 19 may be the upper portion 4*a* and the portion of the leg below the coupling point 19 may be the lower portion 4*b***.

Figure 6:
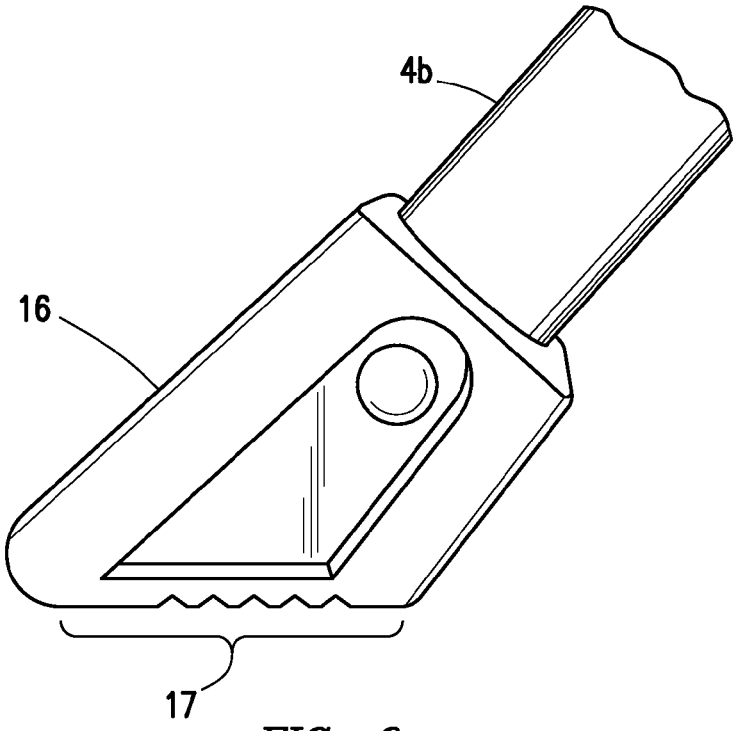
FIG. 6 is a side view of a chair foot according to certain embodiments of the present disclosure.

Feet 16 may be coupled to the frame. FIG. 6 depicts a foot 16 coupled to the end of a lower portion of a leg **4*b*. Feet 16 may have a textured base 17, among other reasons, to improve the grip and/or traction of feet 16** on the ground or surface on which they are placed.

With reference to FIG. 1, the back vertical posts **2*b* support the back 7. In certain embodiments, the seat 6, back 7, and armrests 8 may be slidably coupled to the vertical posts 2, cross-braces 3, and legs 4. A portion 12 of the cross-braces 3 may extend higher than the rest of the frame to support the armrests 8. Cupholders 11 may depend from the armrests 8**.

Figure 2:
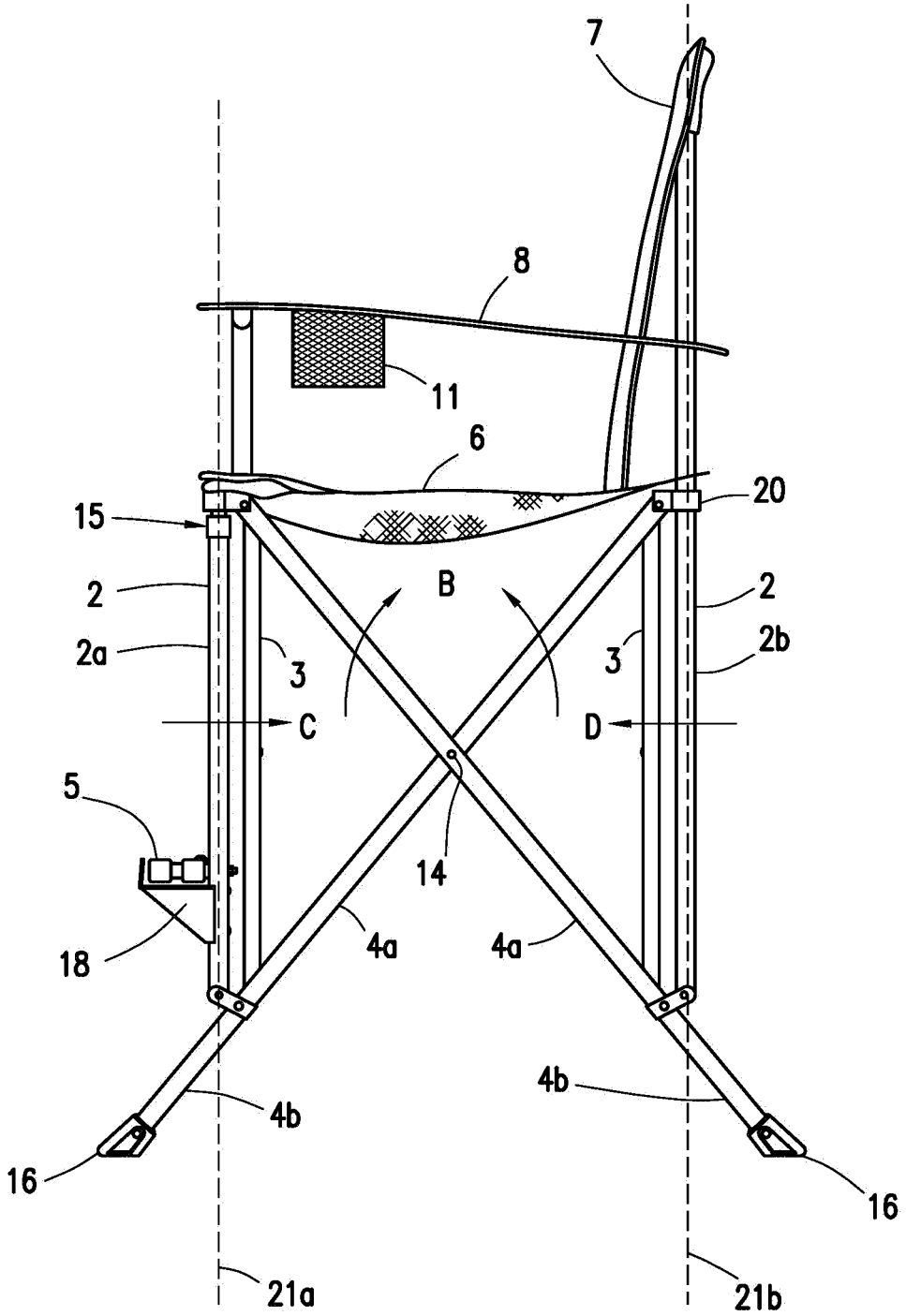
FIG. 2 is a side view of a chair configuration according to certain embodiments of the present disclosure.

FIGS. 1 and 2 show a front plane 21*a* and a back plane 21*b*. In those FIGS., the front plane 21*a* is defined by the front vertical posts 2*a*, and the back plane 21*b* is defined by back vertical posts 2*b*. As used, herein, "define" means that the plane is a 2D plane in space containing the axes of both posts. For example, the front plane 21*a* is defined by the front vertical posts 2*a* and is a 2D plane comprising the axes of both front vertical posts 2*a*. In certain embodiments, other planes may be defined by other vertical posts (not depicted). For example, in certain embodiments, a side plane may be defined by one of the front posts 2*a* and one of the back vertical posts 2*b*.

As depicted in FIGS. 1 and 2, lower portions of the legs 4*b* may extend outwardly from the upper portion of each leg 4*a* beyond one or more planes 16. In some embodiments, the outwardly extending lower portions 4*b* provide more stability than they would if they did not extend beyond the planes 16. In some embodiments, the lower portions 4*b* of only one pair of legs 4 would extend beyond a plane. For example, in certain embodiments, the lower portion 4*b* of one pair of legs 4 would extend beyond the back plane 21*b* but the lower portion 4*b* of another pair of legs 4 would not extend beyond the front plane 21*a*. In certain embodiments, the lower portions 4*b* of one pair of legs 4 would extend beyond front plane 21*a* and the lower portions 4*b* of another pair of legs 4 would extend beyond back plane 21*b*. In some embodiments, the lower portions 4*b* may extend beyond other planes (not depicted) defined by the vertical posts 2.

Figure 3:
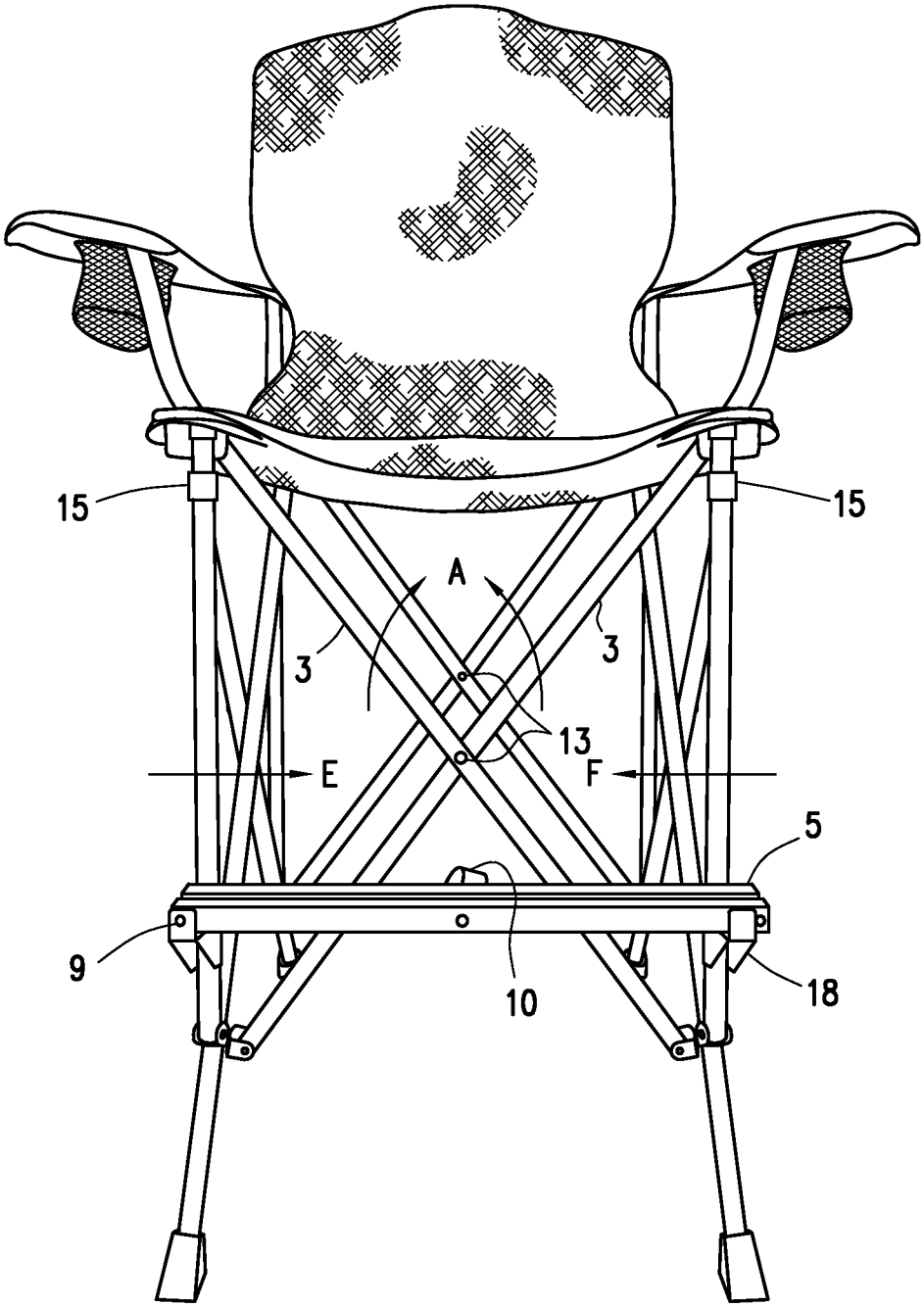
FIG. 3 is a front view of a chair configuration comprising a horizontal step according to certain embodiments of the present disclosure.

FIG. 2 shows the legs 4 coupled together at pivot points 14, and FIG. 3 shows cross-braces 3 coupled together at pivot points 13. With reference to FIGS. 2 and 3, in certain embodiments the folding chair 1 collapses by folding the cross-braces 3 and legs 4 together, such that they pivot at pivot points 13, 14 in directions A and B. The back vertical posts 2*b* may be slidably coupled to the cross-braces 3 and the legs 4 at junctions 20. In some embodiments, the front vertical posts 2*a* may telescope at a telescoping point 15. In some embodiments, the vertical posts 2 may be coupled to the cross-braces 3 and legs 4 such that collapsing the chair 1 by pivoting the cross-braces 3 and legs 4 may move the vertical posts 2 in directions C, D, E, and F.

In certain embodiments, the step 5 may serve as a foothold to facilitate entrance into and exit from the folding chair 1, as a support to stabilize the frame, and/or as a footrest for comfort. In some embodiments, the step 5 may provide sufficient support to allow a user to put some or all of their weight on the step 5 while entering or exiting the chair 1. In certain embodiments, the step 5 may stabilize the frame by connecting one or more elements of the frame. In certain embodiments, the step 5 may be positioned at a height such that the user can rest their feet on it while seated.

Figure 7:
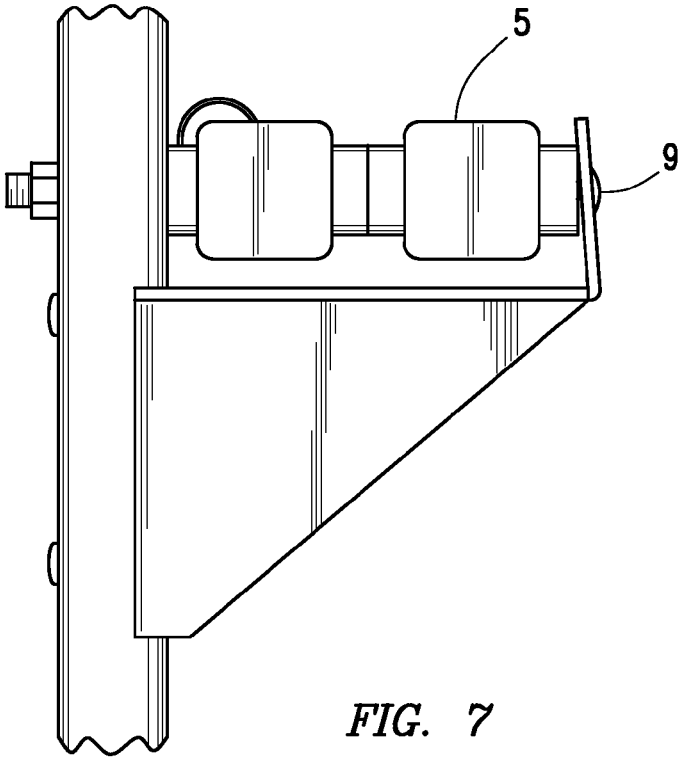
FIG. 7 is a side view of a step according to certain embodiments of the present disclosure.

In certain embodiments, the step 5 may be coupled to a vertical post 2, cross-brace 3, and/or leg 4, or any combination thereof. In certain embodiments, the step 5 may be pivotally coupled to the front of the frame below the seat 6 at a pivot 9. Although the step 5 is depicted in FIGS. 1 and 7 as two elongated rectangular beams coupled together, in certain embodiments, the step 5 could be another suitable shape, size, or configuration. For example, the step 5 could comprise a plank, rod, arm, handle, member, platform, strut, truss, and/or any other structure suitable to serve as a step, footrest, and/or support.

Figure 4:
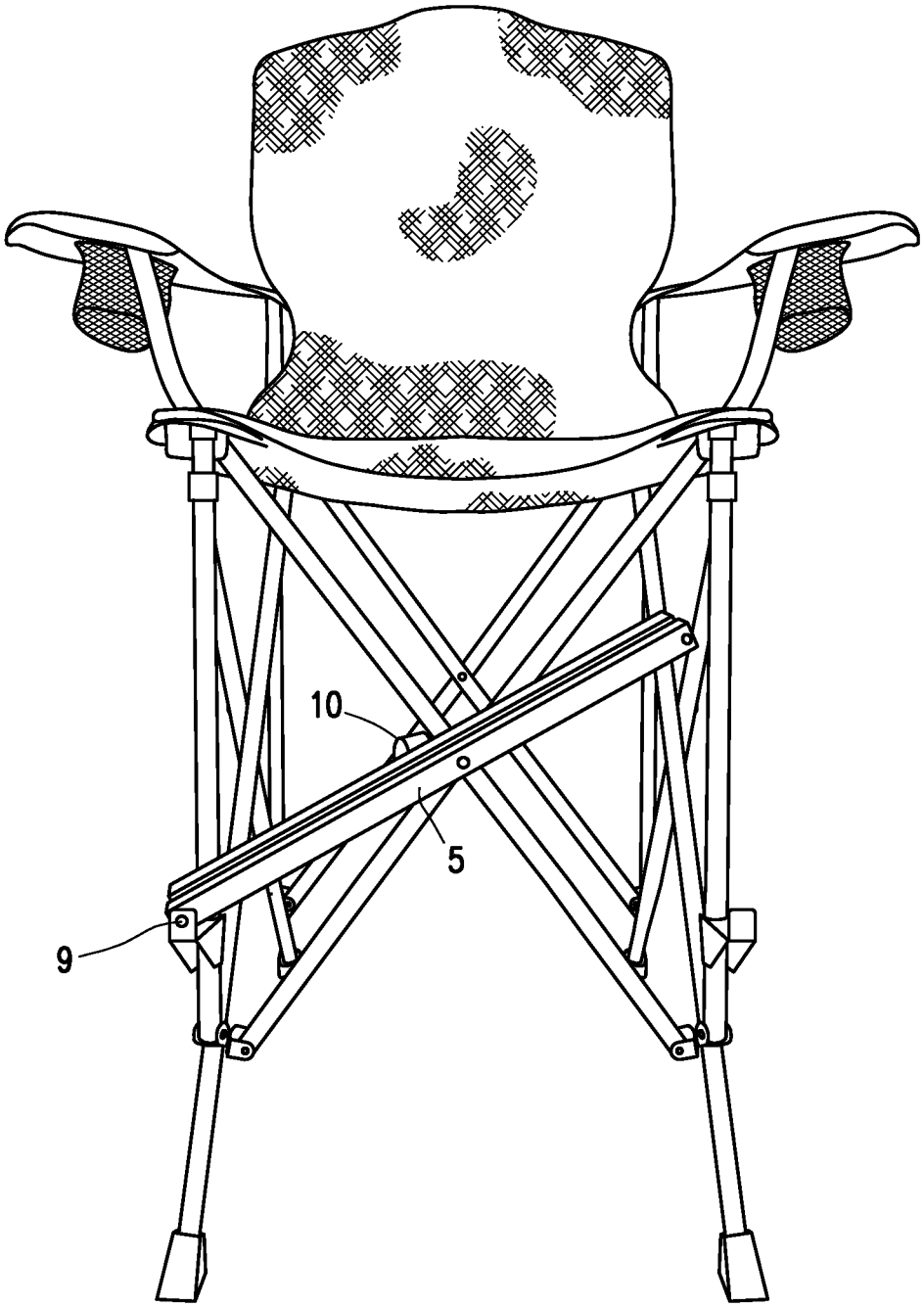
FIG. 4 is a front view of a chair configuration comprising a partially pivoted step according to certain embodiments of the present disclosure.
Figure 5:
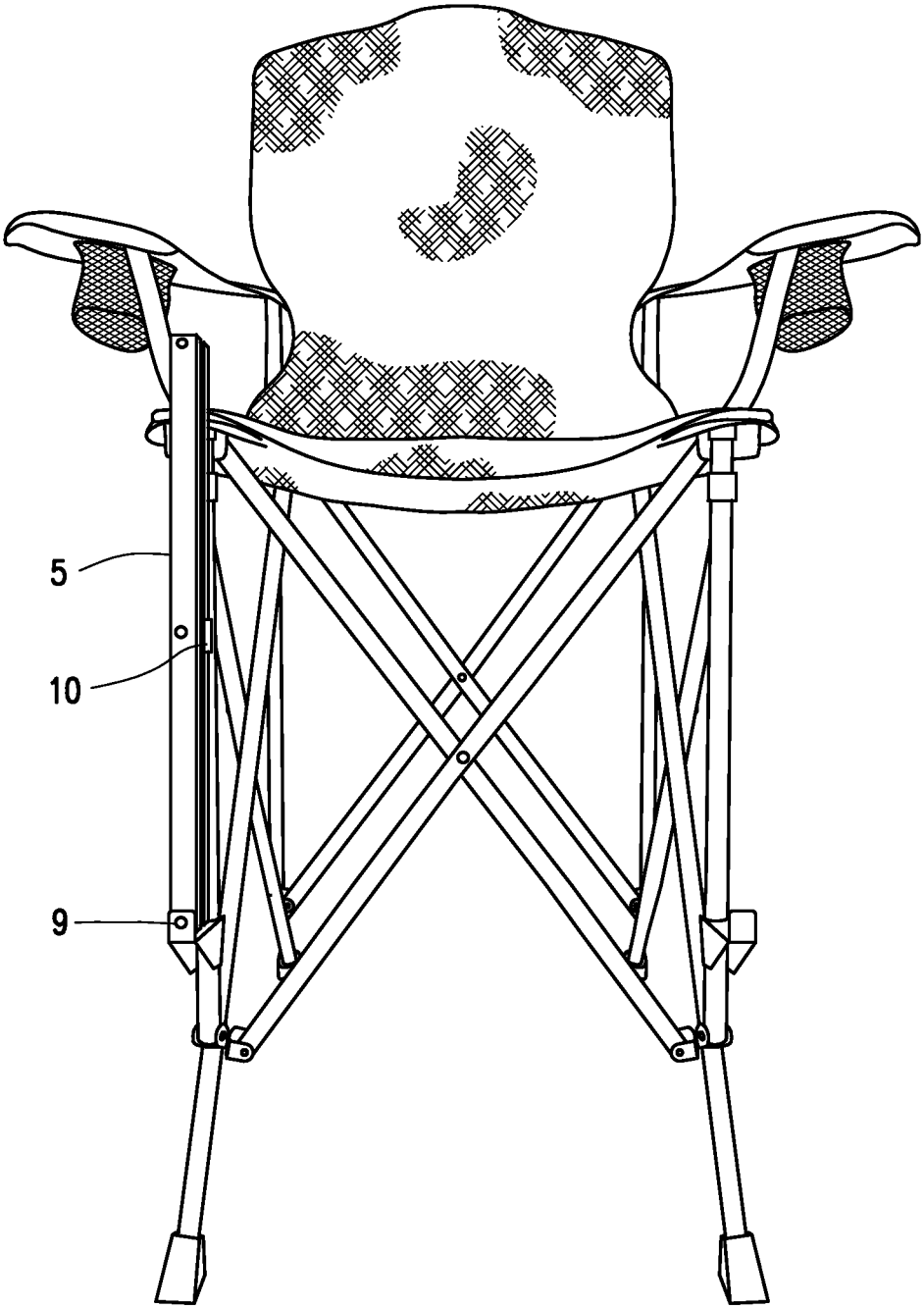
FIG. 5 is a front view of a chair configuration comprising a vertical step according to certain embodiments of the present disclosure.

With reference to FIGS. 3-5, the step 5 may be pivotally coupled to the frame such that it can pivot around the step pivot 9 from a horizontal orientation to a vertical orientation. In some embodiments, when the folding chair 1 is unfolded, the step 5 may be manually manipulated by the user from a vertical orientation (FIG. 5) to a horizontal orientation (FIG. 3). In some embodiments, the step 5 does not automatically move from a vertical orientation (FIG. 5) to a horizontal orientation (FIG. 3). As used herein, the term "does not automatically move" means that some direct manual manipulation is required. In some embodiments, collapsing the chair may require manually manipulating the step 5 from the horizontal orientation to the vertical orientation. In some embodiments, the step 5 may rest on platform 18. FIG. 1-3 depicts the step 5 in a horizontal orientation resting on the platform 18. Although FIGS. 1-3 depict the platform 18 extending from the vertical post 2*a*, in certain embodiments, the platform 18 could be coupled to a leg 4 or cross-brace 3. Although the platform 18 is depicted as a flat surface with a lip, in some embodiments, the platform 18 could be a rod, beam, loop, or other suitable configuration. In certain embodiments, the platform 18 may comprise a fastener (not depicted) to detachably couple the step 5 to the frame.

In some embodiments, the step 5 may be detachably coupled to the frame by a fastener 10. In certain embodiments, the fastener 10 may comprise a snap, hook and loop, or other securing means. In some embodiments, the fastener 10 may require manual engagement or disengagement to attach or detach from the frame, respectively.

Examples of materials that may be suitable for the vertical posts 2, cross-braces 3, legs 4, and step 5 of the present disclosure include, but are not limited to metal, wood, polymers, or any combination thereof. Although depicted as tubular, in certain embodiments, the vertical posts 2, cross-braces 3, and legs 4 may be rectangular, triangular, or any other suitable shape. Examples of materials that may be suitable for feet 16 include, but are not limited to polymers, rubber, or another suitable material. Examples of materials that may be suitable for the seat 6 and back 7 include, but are not limited to cloth, a polymer, or any combination thereof.

Examples of couplings that may be suitable for embodiments of the present disclosure may comprise slidably coupling components, rotatably coupling components, pivotally coupling components, detachably coupling components, hinges, pins, pivots, guide rails, and/or telescoping components. In some embodiments, telescoping components may comprise a larger member coupled to a smaller member, wherein the smaller member fits inside the larger member. In certain embodiments, the two members of the telescoping component are slidably coupled so that the length of the telescoping component may be altered.

In certain embodiments, when the chair is in an unfolded configuration, the seat is at least 16 inches off the ground. In some embodiments, the seat is from about 16 to about 30 inches off the ground. In some embodiments, the unfolded seat is at least 30 inches off the ground. In certain embodiments, when the chair is in an unfolded configuration, the top of the back of the folding chair is from about 25 inches to about 60 inches off the ground.

An embodiment of the present disclosure is a folding chair apparatus, comprising: a plurality of vertical posts, a plurality of cross-braces, and a plurality of legs comprising an upper portion and a lower portion, wherein the legs, cross-braces, and vertical posts are coupled together to form a frame, wherein the vertical posts define one or more planes, and wherein the lower portions of at least two legs extend outwardly from the upper portions of the at least two legs beyond at least one of the planes; and a seat coupled to the frame.

An embodiment of the present disclosure is a folding chair apparatus comprising: a plurality of vertical posts, a plurality of cross-braces, and a plurality of legs comprising an upper portion and a lower portion, wherein the legs, cross-braces, and vertical posts are coupled together to form a frame, wherein a pair of back vertical posts define a back plane, and wherein the lower portion of at least two legs extends outwardly from the upper portion of the at least two legs beyond the back plane; and a seat coupled to the frame.

An embodiment of the present disclosure is a folding chair apparatus, comprising: a plurality of vertical posts, a plurality of cross-braces, and a plurality of legs comprising an upper portion and a lower portion, wherein the legs, cross-braces, and vertical posts are coupled together to form a frame, wherein a pair of front vertical posts define a front plane and a pair of back vertical posts define a back plane, and wherein the lower portion of at least two legs extends outwardly from the upper portion of the at least two legs beyond the front plane, wherein the lower portion of at least two legs extends outwardly from the upper portion of the at least two legs beyond the back plane; and a seat coupled to the frame.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A folding chair apparatus, comprising: a plurality of vertical posts, a plurality of cross-braces, and a plurality of continuous legs comprising an upper portion and a lower portion, wherein the lower portion of each of the plurality of continuous legs extends in a direction parallel to the upper portion of each of the plurality of continuous legs, wherein the plurality of continuous legs, the plurality of cross-braces, and the plurality of vertical posts are coupled together to form a frame, wherein the plurality of vertical posts define one or more planes, and wherein the lower portion of each of the plurality of continuous legs extends outwardly from the upper portion of each of the plurality of continuous legs beyond at least one of the one or more planes; a seat coupled to the frame; and a step pivotally coupled to at least one of the plurality of cross-braces, the plurality of vertical posts, or the plurality of continuous legs, wherein the step is positioned at a front of the chair below the seat.

2. The folding chair apparatus of claim 1, wherein the step is detachably coupled to the frame.

3. The folding chair apparatus of claim 1, wherein the step may be manually manipulated from a vertical to a horizontal orientation when the folding chair apparatus is unfolded.

4. The folding chair apparatus of claim 1, wherein the step does not automatically move from a vertical to a horizontal orientation when the folding chair apparatus is unfolded.

5. The folding chair apparatus of claim 1, further comprising armrests slidably coupled to the frame.

6. The folding chair apparatus of claim 1, wherein the seat is at least 16 inches off the ground.

7. The folding chair apparatus of claim 1, wherein the seat is at least 30 inches off the ground.

8. The folding chair apparatus of claim 1, wherein at least two of the plurality of vertical posts are telescoping posts.

9. The folding chair apparatus of claim 1, wherein at least two of the plurality of vertical posts are slidably coupled to the plurality of cross-braces and the plurality of continuous legs.

10. The folding chair apparatus of claim 1, wherein the seat has a back coupled to the frame.

11. The folding chair apparatus of claim 1, wherein one or more feet are coupled to the frame.

12. The folding chair apparatus of claim 1, wherein the step is coupled to at least two vertical posts.

13. A folding chair apparatus, comprising:

a plurality of vertical posts, a plurality of cross-braces, and a plurality of continuous legs comprising an upper portion and a lower portion, wherein the lower portion of each of the plurality of continuous legs extends in a direction parallel to the upper portion of each of the plurality of continuous legs, wherein the plurality of continuous legs, the plurality of cross-braces, and the plurality of vertical posts are coupled together to form a frame, wherein a pair of back vertical posts of the plurality of vertical posts define a back plane, wherein the lower portion of at least two of the plurality of continuous legs extends outwardly from the upper portion of at least two legs of the plurality of continuous legs beyond the back plane, wherein a pair of front vertical posts of the plurality of vertical posts define a front plane, and wherein the lower portion of at least two of the plurality of continuous legs extends outwardly from the upper portion of at least two of the plurality of continuous legs beyond the front plane; and a seat coupled to the frame.

14. The folding chair apparatus of claim 13, further comprising a step pivotally coupled to at least one of the plurality of cross-braces, the plurality of vertical posts, or the plurality of continuous legs, wherein the step is positioned at a front of the chair below the seat.

15. The folding chair apparatus of claim 14, wherein the step does not automatically move from a vertical to a horizontal orientation when the folding chair apparatus is unfolded.

16. The folding chair apparatus of claim 14, wherein the step is detachably coupled to the frame.

17. A folding chair apparatus, comprising:

a plurality of vertical posts, a plurality of cross-braces, and a plurality of continuous legs comprising an upper portion and a lower portion, wherein the lower portion of each of the plurality of continuous legs extends in a direction parallel to the upper portion of each of the plurality of continuous legs, wherein the plurality of continuous legs, plurality of cross-braces, and plurality of vertical posts are coupled together to form a frame, wherein a pair of front vertical posts of the plurality of vertical posts define a front plane and a pair of back vertical posts of the plurality of vertical posts define a back plane, wherein the lower portion of at least two of the plurality of continuous legs extends outwardly from the upper portion of at least two of the plurality of continuous legs beyond the front plane, and wherein the lower portion of at least two of the plurality of continuous legs extends outwardly from the upper portion of at least two of the plurality of continuous legs beyond the back plane; and a seat coupled to the frame.

18. The folding chair apparatus of claim 17, further comprising a step pivotally coupled to at least one of the of the plurality of cross-braces, the plurality of vertical posts, or the plurality of continuous legs, wherein the step is positioned at a front of the chair below the seat.

19. The folding chair apparatus of claim 18, wherein the step does not automatically move from a vertical to a horizontal orientation when the folding chair apparatus is unfolded.

* * * * *